US011992724B1

(12) United States Patent
Reap

(10) Patent No.: US 11,992,724 B1
(45) Date of Patent: May 28, 2024

(54) CABLE HANDLES

(71) Applicant: Oscar D. Reap, Milwaukee, WI (US)

(72) Inventor: Oscar D. Reap, Milwaukee, WI (US)

( * ) Notice: Subject to any disclaimer, the term of this patent is extended or adjusted under 35 U.S.C. 154(b) by 151 days.

(21) Appl. No.: 17/467,612

(22) Filed: Sep. 7, 2021

(51) Int. Cl.
*A63B 21/00* (2006.01)

(52) U.S. Cl.
CPC ..... *A63B 21/4035* (2015.10)

(58) Field of Classification Search
CPC .... A63B 7/00; A63B 7/02; A63B 7/04; A63B 21/0004; A63B 21/08; A63B 21/0442; A63B 21/055; A63B 21/0552; A63B 21/0555; A63B 21/0557; A63B 21/15; A63B 21/151; A63B 21/4027; A63B 21/4033; A63B 21/4035; A63B 21/4039; A63B 2244/09; A63B 5/20; A63B 5/205; A63B 21/00043
See application file for complete search history.

(56) References Cited

U.S. PATENT DOCUMENTS 4,423,866 A * 1/1984 Stolba ..... A63B 5/20 482/82
4,647,037 A * 3/1987 Donohue ..... A63B 5/20 482/82
4,778,173 A * 10/1988 Joutras ..... A63B 23/16 482/82
4,869,492 A * 9/1989 Joutras ..... A63B 21/4047 482/44
D484,929 S * 1/2004 Mollet ..... A63B 21/156 D21/684
7,473,213 B1 1/2009 Kallenbach
7,691,040 B1 4/2010 Schwinghamer
8,105,217 B2 1/2012 Alessandri et al.
9,011,304 B2 4/2015 Gillman
9,370,685 B2 6/2016 Watry
9,463,347 B2 10/2016 Kristiansen
9,814,924 B2 11/2017 Chen
10,335,628 B1 * 7/2019 Scarpa ..... A63B 21/00061
D857,132 S * 8/2019 Dube ..... A63B 21/4047 D21/694
2003/0109324 A1 * 6/2003 Novotny ..... A63B 69/3623 473/257
2005/0288158 A1 * 12/2005 LaTour ..... A63B 5/20 482/81
2006/0100071 A1 * 5/2006 Elmhirst ..... A63B 21/06 482/94
2010/0267523 A1 * 10/2010 Wilkinson ..... A63B 21/0726 482/45

(Continued)

*Primary Examiner* — Gary D Urbiel Goldner
(74) *Attorney, Agent, or Firm* — Cramer Patent & Design PLLC; Aaron R. Cramer

(57) ABSTRACT

A pair of cable handles having a removable ergonomic grip disposed about a threaded tube and end caps. A metallic hemi-spherical cable connector is secured within one of the end caps. The pair of cable handles includes a central shaft that is assembled during manufacture by sliding the central shaft through a rigid inner section, applying, or sliding the rigid inner section through the removable ergonomic grip and then applying a lower cap of the end caps by use of interior threaded female section. Additionally, the lower cap provides for a protruding edge that a user's hand bears against which also enhances the grip and allows for an application of more force.

1 Claim, 5 Drawing Sheets

(56) References Cited

U.S. PATENT DOCUMENTS

| | | | | |
|---|---|---|---|---|
| 2011/0130255 | A1* | 6/2011 | Charlton | A63B 21/0552 482/129 |
| 2012/0135844 | A1* | 5/2012 | Huang | A63B 21/05 482/108 |
| 2013/0274074 | A1* | 10/2013 | Ghandour | A63B 15/00 482/93 |
| 2014/0329650 | A1* | 11/2014 | Watry | A63B 69/0093 482/139 |
| 2015/0119206 | A1* | 4/2015 | Newman | A63B 5/20 482/82 |
| 2017/0282003 | A1* | 10/2017 | Giafardino | A63B 15/00 |
| 2017/0296860 | A1* | 10/2017 | Watry | A63B 21/4035 |
| 2018/0133540 | A1* | 5/2018 | McCrea | A63B 21/156 |
| 2018/0221703 | A1* | 8/2018 | Newman | A63B 21/4039 |
| 2019/0192897 | A1* | 6/2019 | Meyer | A63B 21/151 |
| 2020/0047019 | A1* | 2/2020 | Meyer | A63B 21/0557 |
| 2022/0134175 | A1* | 5/2022 | Lomangino | A63B 21/151 482/139 |
| 2022/0152441 | A1* | 5/2022 | Karnes, Jr. | A63B 21/00043 |

* cited by examiner

CABLE HANDLES

FIELD OF THE INVENTION

The present invention relates generally to a handle for a cable and more specifically for a cable associated with a piece of exercise equipment.

BACKGROUND OF THE INVENTION

Physical fitness and health concerns are among the areas of highest concern among Americans today. More than ever, people are frequenting health clubs and performing exercise routines at home in order to lose weight, improve muscle tone and maintain a healthy lifestyle. One common item found on many different types of cable-based 20 exercise equipment is that of hand grips used to pull weights attached to opposite ends of the cable, often through a pulley system.

While certainly functional, many find these grips lacking in their ability to provide a sure grip. They may be too small and are typically not provided with a 25 stop surface in which to pull against. Another common complaint is that they typically become very slippery and may even slip completely out of a sweaty hand. Accordingly, there exists a need for a means by which hand grips used on cable-based weight equipment can be enhanced to address the above-mentioned problems. The development of the cable handles fulfills this need.

SUMMARY OF THE INVENTION

To achieve the above and other objectives, the present invention provides for a handle device, having, a central handle section having a first end, a second end, and a rigid inner section, an upper cap disposed on the first end of the central handle, a lower cap disposed on the second end of the central handle, a compressible outer section disposed on the rigid inner section, and a central shaft having a first end and a second end. the central shaft and a threaded male section are disposed within a central hole that runs along a central axial length of the rigid inner section.

The rigid inner section and the compressible outer section may be an ergonomically comfortable surface that reduces slippage during usage. The upper cap may include an eyelet. The eyelet may be an integral component of the upper cap. The eyelet may be secured within the clamp. The lower cap, and the eyelet may be made from a process selected from the group consisting of a stamping process, a casting process, or a machining process. The eyelet may be made of steel. The upper cap may be made of steel. The lower cap may be made of steel. The lower cap may include a protruding edge that a user's hand is adapted to bear against which enhances a user's grip and allows for application of more force to the lower cap.

A symmetrical circular nature of the compressible outer section may be adapted to allow a user to grip the central handle section around its 360° central axis. The compressible outer section may be made of foam rubber. The first end of the central shaft may be coupled to the upper cap and the second end of the central shaft may be coupled to the lower cap. The first end of the central shaft may be coupled to the upper cap and the second end of the central shaft may be coupled to the lower cap with a plurality of interior threading. The handle device may be attached to an exercise machine cable with a fastener. The fastener may be a clamp. The fastener may be a quick-release clamp. The fastener may be a ferrule. The handle device may be 8 to 9 inches long. The handle device may be 1½-2¼ inches in diameter.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
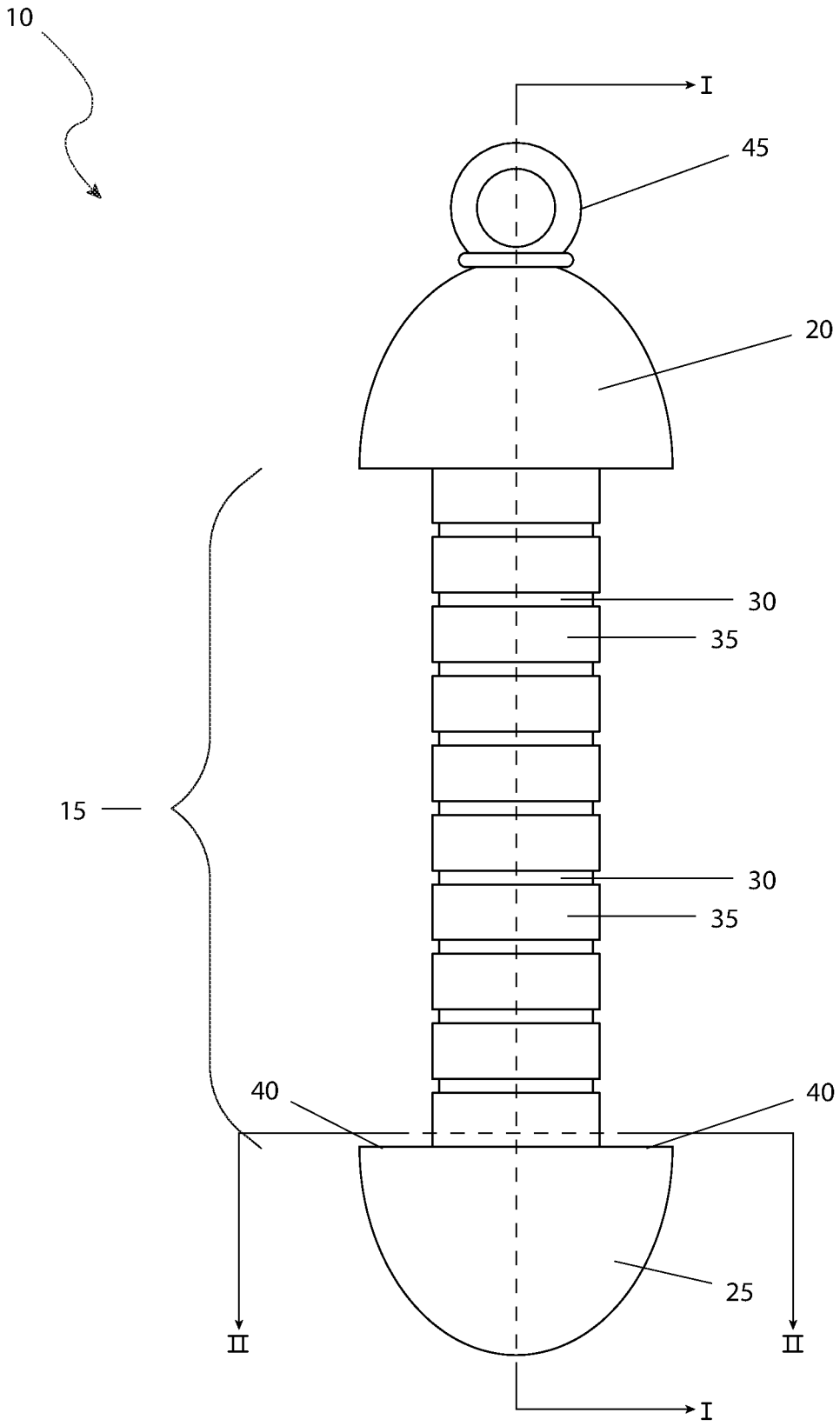
FIG. 1 is a side view of the handle device, according to the preferred embodiment of the present invention.

10 handle device
15 handle section
20 upper cap
25 lower cap
30 rigid inner section
35 compressible outer section
40 protruding edge
45 eyelet
50 central shaft
55 threaded male section
60 interior threaded female section
65 central hole
70 exercise machine cable
75 fastener
80 clamp
85 loop
90 cable-based exercise equipment
95 travel path "q"

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a side view of the handle device 10, according to the preferred embodiment of the present invention is disclosed. The handle device (herein also described as the "device") 10 is particularly suited for use on cable-based gym equipment 90. The device 10 comprises a central handle section 15 bordered by an upper cap 20 and a lower cap 25. The handle section 15 is provided with a rigid inner section 30 and a set of compressible outer section 35 such as foam rubber. The combination of the rigid inner section 30 and the compressible outer section 35 working together produces an ergonomically comfortable surface that provides for reduced slippage during usage. The symmetrical circular nature of the compressible outer section 35 allows the user to grip the device 10 in any manner around its three-hundred-sixty-degree (360°) central axis. Additionally, the lower cap 25 provides for a protruding edge 40 that the user's hand can bear against which also enhances the grip and allows for the application of more force. This feature provides for an enhanced workout in which greater levels of resistance afforded by the invention generate stronger and larger muscles over time when compared to conventional hand grips.

The distal end of the upper cap 20 is provided with an eyelet 45 which may or may not be provided as an integral component of the upper cap 20. The upper cap 20, the lower cap 25, and the eyelet 45 are envisioned to be manufactured from steel in a stamping, casting, and/or machining process. The overall size of the invention is envisioned to be approximately eight to nine inches (8-9 in.) long and approximately one and one-half to two and one-quarter inches (1½-2¼ in.) in diameter. However, other dimensions will work with equal effectiveness. As such, the overall dimensions of the invention as well as the specific materials of construction are not intended to be a limiting factor of the present invention.

Figure 2:
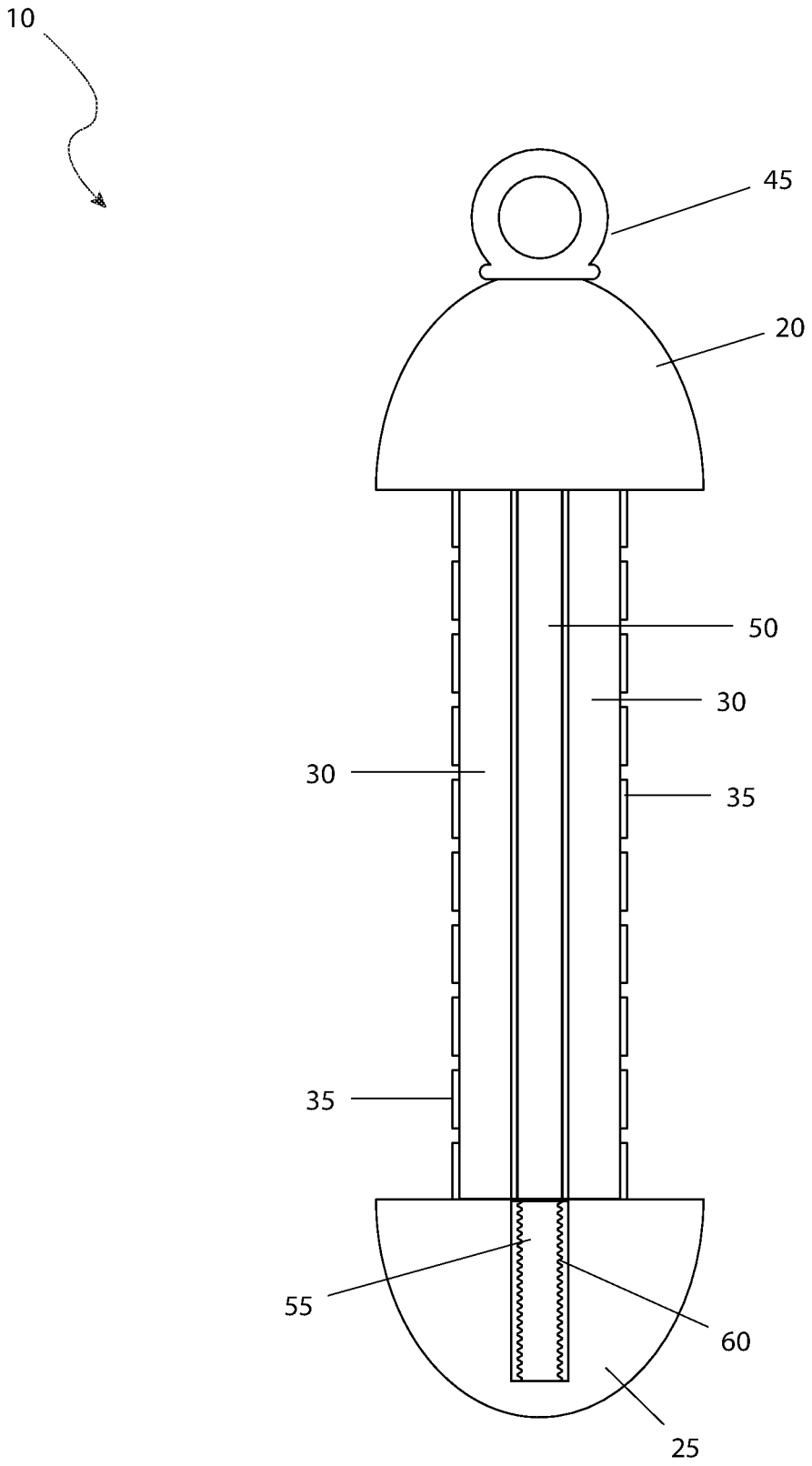
FIG. 2 is a sectional view of the handle device, as seen along a Line I-I, as shown in FIG. 1, according to the preferred embodiment of the present invention.

Referring next to FIG. 2, a sectional view of the device 10, as seen along a Line I-I, as shown in FIG. 1, according to the preferred embodiment of the present invention is depicted. A central shaft 50 is provided as a part of the upper cap 20. Similar in nature to the eyelet 45, the central shaft 50 may or may not be provided as an integral component of the upper cap 20. The distal end of the central shaft 50 terminates in a threaded male section 55. In such a manner, the central shaft 50 may be assembled during manufacture by sliding the central shaft 50 through the rigid inner section 30, applying or sliding the rigid inner section 30 through the compressible outer section 35 and then applying the lower cap 25 by use of interior threaded female section 60. Those skilled in the art will realize other methods of possible assembly such as nuts, cover caps, and the like which will allow attachment of the central shaft 50 to the lower cap 25.

Figure 3:
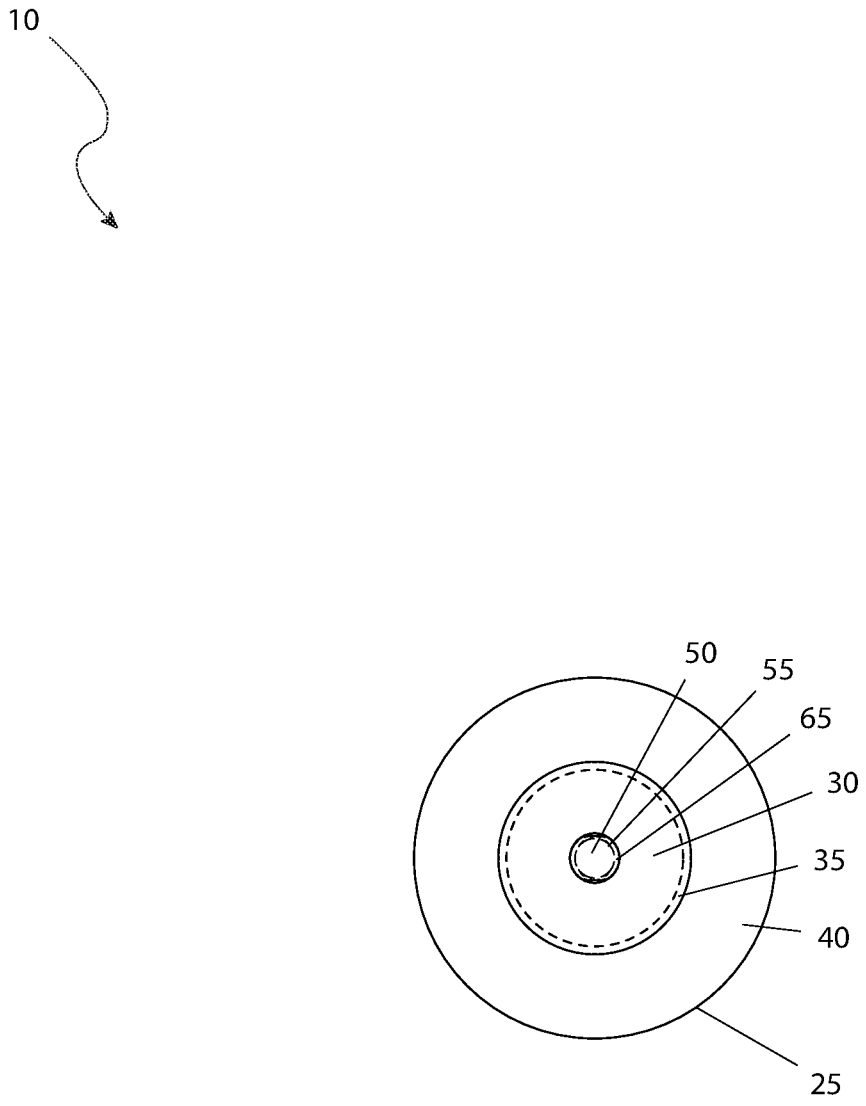
FIG. 3 is a sectional view of the handle device, as seen along a Line II-II, as shown in FIG. 1, according to the preferred embodiment of the present invention.

Referring now to FIG. 3, a sectional view of the device 10, as seen along a Line II-II, as shown in FIG. 1, according to the preferred embodiment of the present invention is shown. The protruding edge 40 is prominently featured immediately inside of the lower cap 25. The rigid inner section 30 is centered with respect to both the lower cap 25 and the central shaft 50. The compressible outer section 35 (here shown in a hidden state via dashed lines) is located on the circumference of the compressible outer section 35. Finally, the central shaft 50 along with the threaded male section 55 is located within a central hole 65 that runs along the central axial length of the rigid inner section 30.

Figure 4:
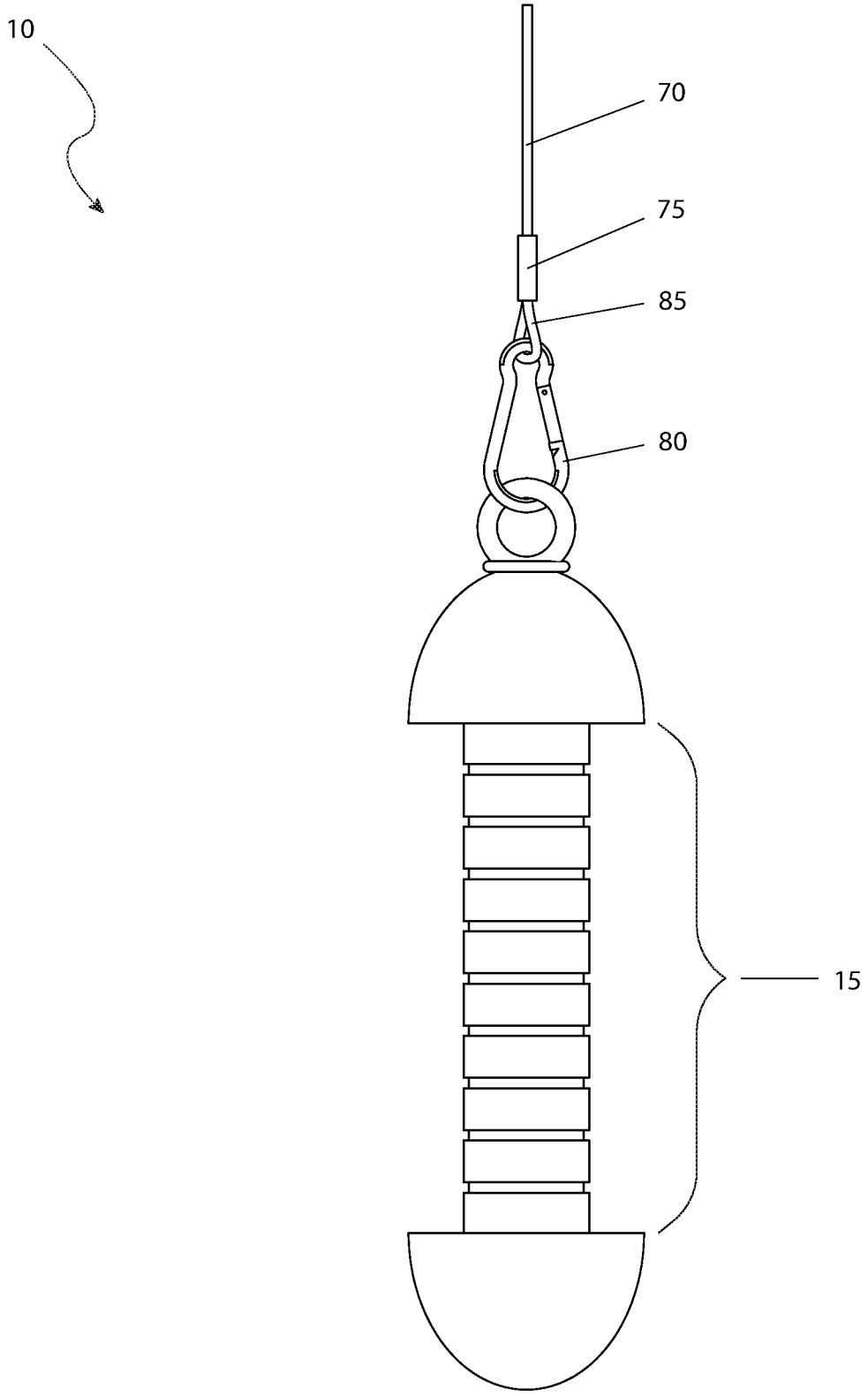
FIG. 4 is a detailed view of the handle device, attached to an exercise machine cable, according to the preferred embodiment of the present invention.

Referring next to FIG. 4, a detailed view of the device 10, attached to an exercise machine cable 70, according to the preferred embodiment of the present invention is disclosed. The exercise machine cable 70 is looped back on itself and secured via a fastener 75 such as a clamp, ferrule or the like. A quick-release clamp 80 is located within the loop 85. The eyelet 45 is then secured within the clamp 80 to form a complete assembly. With the device 10 installed as shown, the user may utilize the handle section 15 to perform a wide range of exercises, without the necessity of holding the exercise machine cable 70 directly or utilizing other types of handle mechanisms that do not operate satisfactorily or with the enhancements provided by the device 10.

Figure 5:
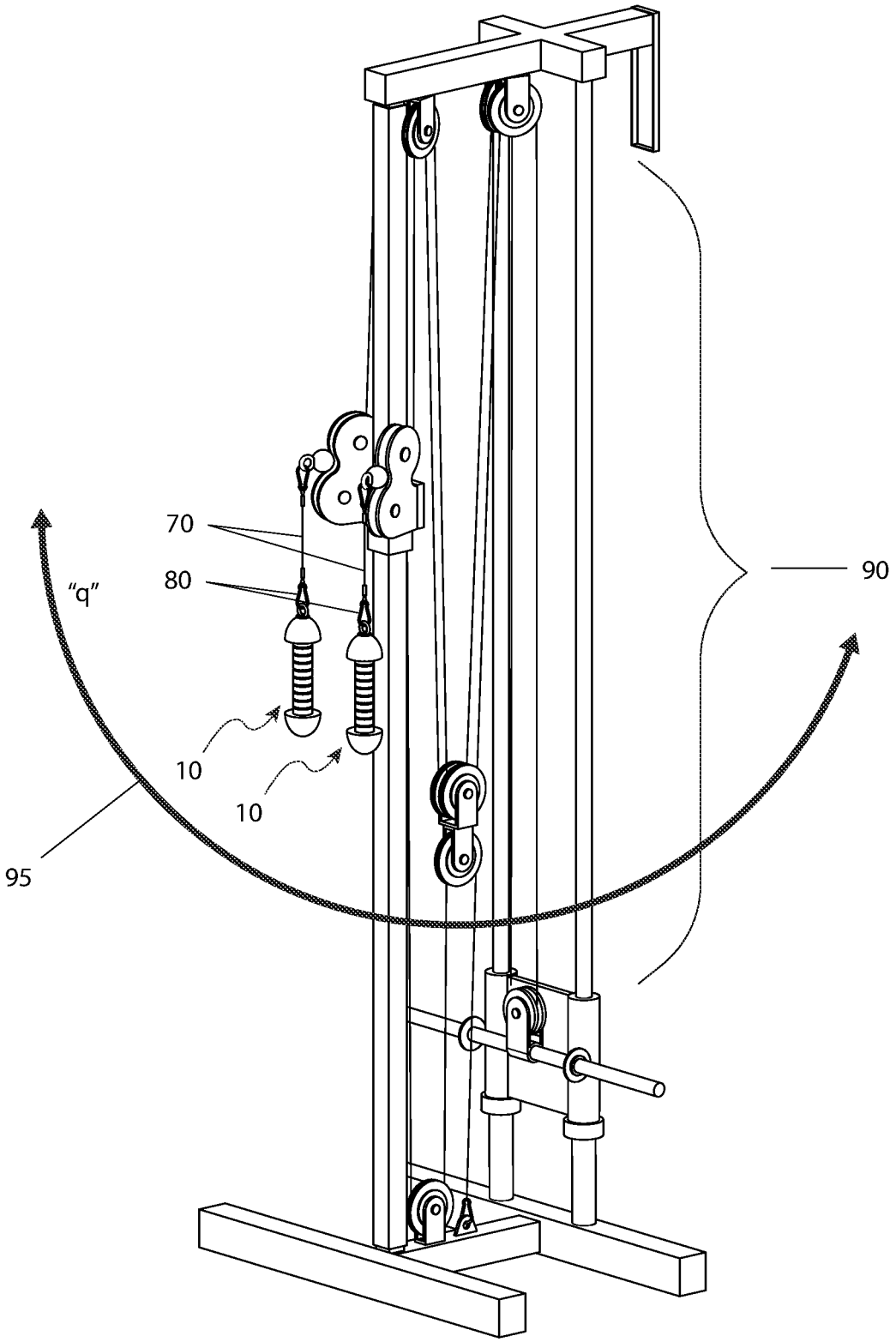
FIG. 5 is a pictorial view of the handle device, shown in a utilized state, according to the preferred embodiment of the present invention.

Referring to FIG. 5, a pictorial view of the device 10, shown in a utilized state, according to the preferred embodiment of the present invention is depicted. A pair of devices 10 are installed upon a cable-based exercise equipment 90. They are secured to the exercise machine cable 70 to the device 10 via the quick release clamp 80 in a customary manner. Once installed, the cable-based exercise equipment 90 is utilized in a conventional manner by pulling on the exercise machine cable 70 anywhere along a quarter of sphere travel path "q" 95. The cable-based exercise equipment 90 as depicted in FIG. 5 is for reference only, as the teachings of the device 10 will apply to any type of cable-based exercise equipment 90. The use of any specific type of cable-based exercise equipment 90 is not intended to be a limiting factor of the present invention. It is envisioned that the device 10 may be left attached to cable-based exercise equipment 90, such as in a gym, for use by all. It is also envisioned that the device 10 may be applied and removed by the user of the cable-based exercise equipment 90 each time. Such usage ensures that the user will always have the capabilities of the device 10 no matter what cable-based exercise equipment 90 or location the user is at.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels such as sporting goods stores, discount stores, department stores, mail order and internet supply houses and the like.

After procurement and prior to utilization, the device 10 would be prepared in the following manner: the device 10 would be attached to the exercise machine cable 70 using the clamp 80 connected to the eyelet 45; the operating controls of the cable-based exercise equipment 90 are adjust with regards to desired height and weight as well as the exercises being done. At this point in time, the device 10 is ready for use.

During utilization of the device 10, the following procedure would be initiated: for one handed exercises; place any hand (right or left) on the handle section 15 of the device 10 and grip firmly during exercise repetitions; for two-handed exercises, the user would place a first hand (right or left) on the handle section 15 of one (1) of the devices 10, while the opposite second hand is engaged with the remaining device 10; the user then assumes the stance required by the exercise and pulls both device 10 along the travel path "q" 95; the motion of the cable-based exercise equipment 90 allows reversal of the travel path allowing for the repetition to be repeated.

After use of the device 10, it (or they) may be left in place on the cable-based exercise equipment 90 or removed for use on different cable-based exercise equipment 90 in a repeating and cyclical manner.

The features of the device 10 provide for a lightweight aerodynamic design that is easy to use. They are durable and made of high-quality material with a comfortable and ergonomic handle section 15. They can be used on any make or model of cable-based exercise equipment 90 and does not require the user to hold the exercise machine cable 70 directly. This results in decreased fatigue and soreness of the user's hands, as well as reduced struggling to reach and hold the opposing device 10 when doing performing two-handed exercises. Additionally, the increased comfort allows the user to perform an increased quantity of repetitions, as well the ability to lift more weight.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A handle device, comprising:

a central handle section having a first end, a second end, and a rigid inner section;

an upper cap disposed on the first end of the central handle section;

a lower cap disposed on the second end of the central handle section;

a compressible outer section disposed on the rigid inner section; and a central shaft having a first end and a second end, the central shaft and a threaded male section thereof are disposed within a central hole of the rigid inner section; and, wherein the compressible outer section disposed on the rigid inner section is an ergonomically comfortable surface that reduces slippage during usage;

wherein the upper cap includes an eyelet;

wherein the eyelet is an integral component of the upper cap;

wherein the eyelet is configured to be secured within a quick-release clamp;

wherein the upper cap, the lower cap, and the eyelet are made from a process selected from the group consisting of a stamping process, a casting process, or a machining process;

wherein the eyelet is made of steel;

wherein the upper cap is made of steel;

wherein the lower cap is made of steel;

wherein the lower cap includes a protruding edge adapted for a hand of a user to bear against which enhances a grip of the user;

wherein a symmetrical circular shape of the compressible outer section is adapted to allow the user to grip the central handle section around a 360° central axis thereof;

wherein the compressible outer section is made of foam rubber;

wherein the first end of the central shaft is coupled to the upper cap and the second end of the central shaft is coupled to the lower cap;

wherein the second end of the central shaft is coupled to the lower cap with a plurality of interior threading of the lower cap; and wherein the handle device is configured to be attached to an exercise machine cable with the quick-release clamp.

* * * * *